US005548850A

United States Patent [19]

Geeham

[11] Patent Number: 5,548,850

[45] Date of Patent: Aug. 27, 1996

[54] TOILET WITH TWO FLUSH MODALITIES

[76] Inventor: Calvin T. Geeham, 12761 138th La. North, Largo, Fla. 34644

[21] Appl. No.: 377,209

[22] Filed: Jan. 24, 1995

[51] Int. Cl.[6] ..... E03D 1/14

[52] U.S. Cl. ..... 4/326; 4/363; 4/411; 4/434; 4/249; 4/252.5; 4/406

[58] Field of Search ..... 4/249, 252.4, 252.5, 4/324, 325, 326, 363, 364, 405, 406, 411, 412, 413, 414, 434, 441, 442

[56] References Cited

U.S. PATENT DOCUMENTS

| | | | |
|---|---|---|---|
| 209,870 | 11/1878 | Demarest | 4/441 |
| 863,778 | 8/1907 | Brooks | 4/441 |
| 1,474,288 | 11/1923 | Rath | 4/326 |
| 1,805,204 | 5/1931 | Brown | 4/326 |
| 2,514,040 | 7/1950 | Eksergian | 4/434 |
| 2,929,073 | 3/1960 | Sarlin | 4/249 X |
| 3,344,439 | 10/1967 | Davies | 4/363 X |
| 3,654,641 | 4/1972 | Braun, Sr. | 4/256.1 |
| 3,877,082 | 4/1975 | Wilhelm | 4/326 |
| 4,987,616 | 1/1991 | Ament | 4/421 |
| 5,090,066 | 2/1992 | Schoepe et al. | 4/378 |
| 5,201,082 | 4/1993 | Rockwell | 4/434 X |

OTHER PUBLICATIONS

Toilet Catalog of Kohler Co., Kohler WI 53044, 1992, 1 sheet.

Kohler Service Parts List for Wellworth Lite Toilet of Kohler Co., Kohler WI 53044, Jan. 1993 1 pg.

Hushflo Fill Valve Instruction Sheet of Plumb Shop, Southfield, MI 48034, dated 1992, 1 pg.

Fluidmaster Toilet Tank Repair Valve Information on Product Box of Fluidmaster, Inc. Anaheim CA 92803, Dec. 1990, 1 pg.

Fluidmaster Toilet Tank Repair Valve Product Instruction Literature of Fluidmaster, Inc. Anaheim CA 92803, Jan. 1994, 1 pg.

Touch Flush Assembly Product Box Literature of Lavelle, Ind. Burlington, WI 53105 Jan. 1994, 1 pg.

*Primary Examiner*—Robert M. Fetsuga
*Attorney, Agent, or Firm*—Peter D. Keefe

[57] ABSTRACT

A two flush modality toilet composed of a bowl, a tank connected with the bowl wherein the tank is connected to a water supply, a conventional flush modality for flushing solid waste from the bowl, and a urinal flush modality for flushing liquid only waste from the bowl, wherein the urinal flush modality includes: a bowl valve at the base of the bowl, a bowl valve control for selecting between open and closed states of the bowl valve, a conduit for directing liquid waste from the bowl into the sanitary drain, and an auxiliary flush control for supplying a limited quantity of flush water from the tank into the bowl to provide restoration of the trap water in the bowl after a urinal flush modality has occurred. A foot pedal selectively operates the bowl valve, wherein when in an open state all the liquid in the bowl is drained. Upon release of the foot pedal, the bowl valve is returned to the closed state. Flush water from the tank is then delivered to the bowl to restore the trap water. Operation may be mechanically effected or electrically effected. With regard to mechanical operation, the flush water from the tank may be introduced by action of the foot pedal or by separate action of a control at the tank.

14 Claims, 5 Drawing Sheets

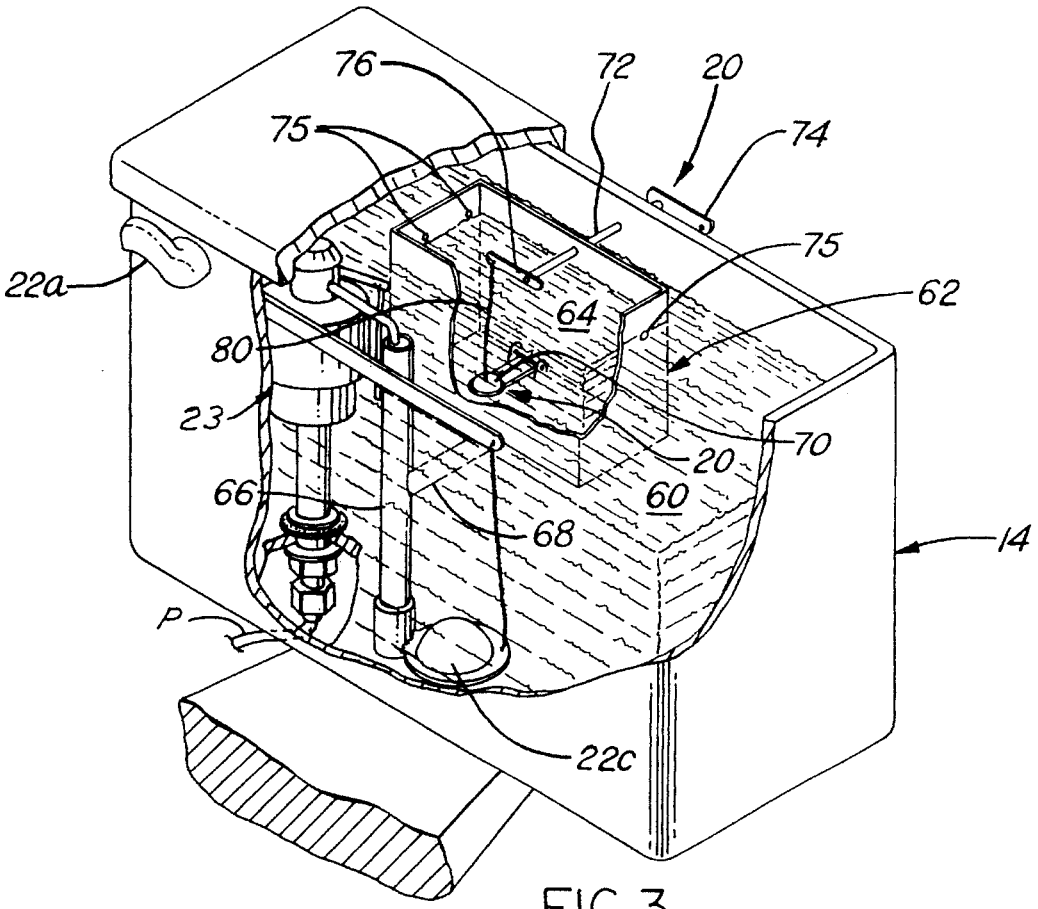
FIG. 3
FIG. 4
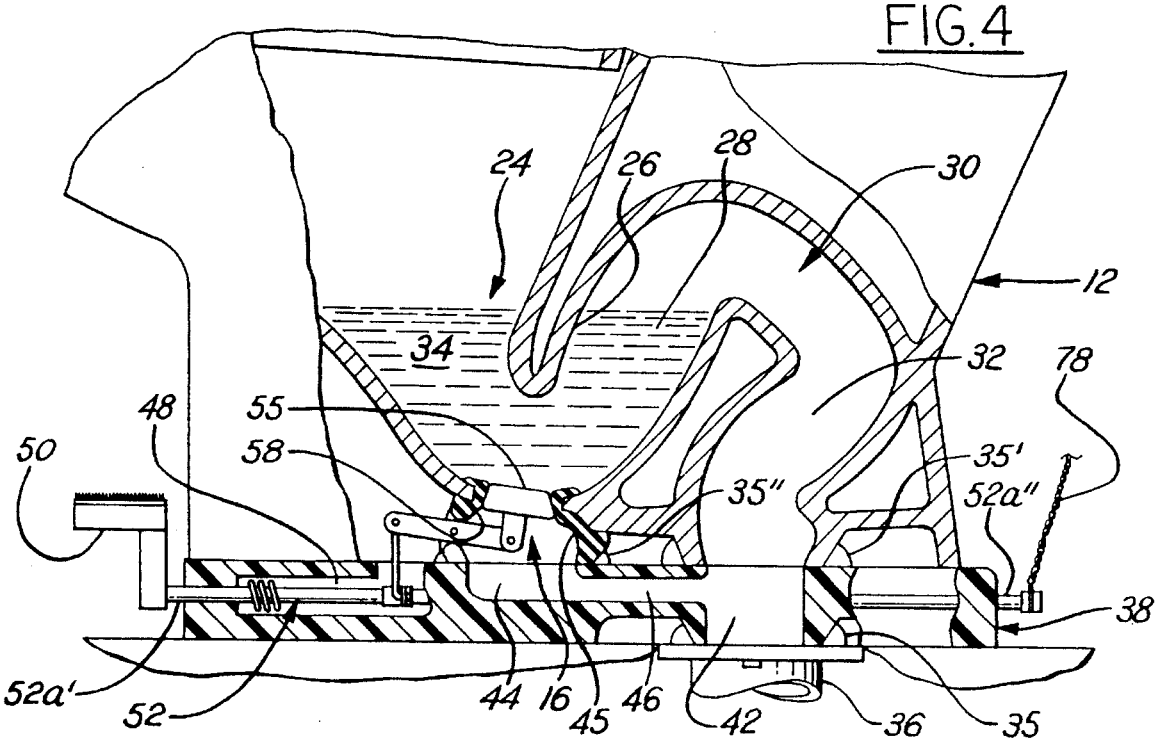

TOILET WITH TWO FLUSH MODALITIES

BACKGROUND OF THE INVENTION

1. Field of the Invention

The present invention relates to toilets (sometimes referred to as "water closets"). More particularly, the present invention relates to toilets having a tank for providing flush water. Still more particularly, the present invention relates to a toilet having a tank for providing flush water, the toilet having two flush modalities: a conventional flush operation for solid waste and a separate urinal flush operation for only liquid waste.

2. Description of the Prior Art

Toilets serve admirably as an efficient and sanitary means to dispose of waste material. Toilets operate upon a flush cycle, wherein waste disposal is performed with the accompaniment of a large quantity of water, usually on the order of three, four or more gallons.

As population densities have increased, the demands upon available water supplies have become quite substantial. Indeed, periodically, certain locales are subject to water rationing, wherein flushing of the toilet is requested to be performed only infrequently. Such a request not only subjects the toilet user to odor, but potentially also to disease due to the stagnancy of pre-used bowl water. Accordingly, a solution to the water demands of toilet flushing with each toilet use would be extremely desirable for both personal and ecological reasons.

One "popular" notion to reduce the amount of flush water needed is to place an object in the tank, such as a water filled plastic milk container, the volume of which diminishing the water volume in the tank. While this sounds not only feasible but practical, one must consider why, in the first place, the toilet manufacturer designed the tank to hold a specified amount of flush water. First, there must be enough flush water to move solid waste in the bowl out of the toilet and into the sanitary drain. Second, there must be still more flush water to flush out the dirty bowl water while at the same time rinsing the bowl clean. Thirdly, there must be enough flush water left over to provide an adequate depth of water at the trap located at the bottom portion of the bowl so that the sanitary drain is fluidically cut-off from the bowl to thereby prevent methane and other sewer gases from backing-up into the bowl, and, thereupon, into the restroom. Thus, reducing the amount of flush water by simply reducing the water stored in the tank may result in insufficient water to properly flush the bowl. More potentially disastrous, is that over time an accumulation of solid waste may become lodged in the sanitary drain, plugging the drain and resulting in back-ups because repeatedly too little flush water was available to move the solid waste out the local sanitary drain and into the main sanitary drain.

Some toilets operate on a flush process wherein less flush water is required, such as described in U.S. Pat. No. 4,987,616 to Ament, dated Jan. 29, 1991. Other toilets combine a lesser amount of flush water in combination with a compressed gas principle. Problematically, these toilets may be subject to drain clogging if insufficient flush water is available to move the flushed solid waste out into the main sanitary drain.

The flushing of liquid waste requires less flush water than does the flushing of solid waste, since the flushing of liquid waste does not entail the potential for drain clogging. Accordingly, what is needed is a toilet which uses only an amount of water which is needed to effect full and complete flushing based upon the particular type of waste being flushed.

SUMMARY OF THE INVENTION

The present invention is a toilet which operates on the basis of two flush modalities: one for flushing solid waste, and a second for flushing only liquid waste.

The two flush modality toilet according to the present invention is composed of a bowl, a tank connected with the bowl wherein the tank is connected to a water supply, a conventional flush modality for flushing solid waste from the bowl, and a urinal flush modality for flushing liquid only waste from the bowl, wherein the urinal flush modality includes: a bowl valve at the lowest point of the bowl, a bowl valve control for selecting between open and closed states of the bowl valve, a conduit for directing liquid waste from the bowl into the sanitary drain, and an auxiliary flush control for supplying a limited quantity of flush water from the tank into the bowl to provide restoration of the trap water in the bowl after a urinal flush modality has been initiated.

A foot pedal selectively operates the bowl valve, wherein when in an open state all the liquid in the bowl is drained. Upon release of the foot pedal, the bowl valve is returned to a closed state. Flush water from the tank is then delivered to the bowl to restore the trap water.

Operation may be mechanically effected or electronically effected. With regard to mechanical operation, the flush water from the tank may be introduced by action of the foot pedal or by separate action of a control at the tank.

Accordingly, it is an object of the present invention to provide a two flush modality toilet.

It is another object of the present invention to provide a two flush modality toilet, wherein the amount of flush water used is dependent upon whether solid or liquid only waste is being flushed.

It is a further object of the present invention to provide a two flush modality toilet, wherein the amount of flush water used is dependent upon whether solid or liquid only waste is being flushed, wherein operation conserves water.

It is yet a further object of the present invention to provide a two flush modality toilet, wherein the amount of flush water used is dependent upon whether solid or liquid only waste is being flushed, the invention being adaptable to existing toilets or provided with newly manufactured toilets.

It is yet another object of the present invention to provide a two flush modality toilet, wherein the amount of flush water used is dependent upon whether solid or liquid only waste is being flushed, wherein the mechanism is simple and reliable.

It is an additional object of the present invention to provide a two flush modality toilet, wherein the amount of flush water used is dependent upon whether solid or liquid only waste is being flushed, wherein operation is easy for a user.

These, and additional objects, advantages, features and benefits of the present invention will become apparent from the following specification.

BRIEF DESCRIPTION OF THE DRAWINGS

FIG. 3 is a partly cut-away perspective view of the tank of the two flush modality toilet of FIG. 1.

FIG. 4 is a partly sectional detail view of the bowl and base of the two flush modality toilet of FIG. 1, shown with the flush valve in a closed state.

DETAILED DESCRIPTION OF THE PREFERRED EMBODIMENTS

Figure 1:
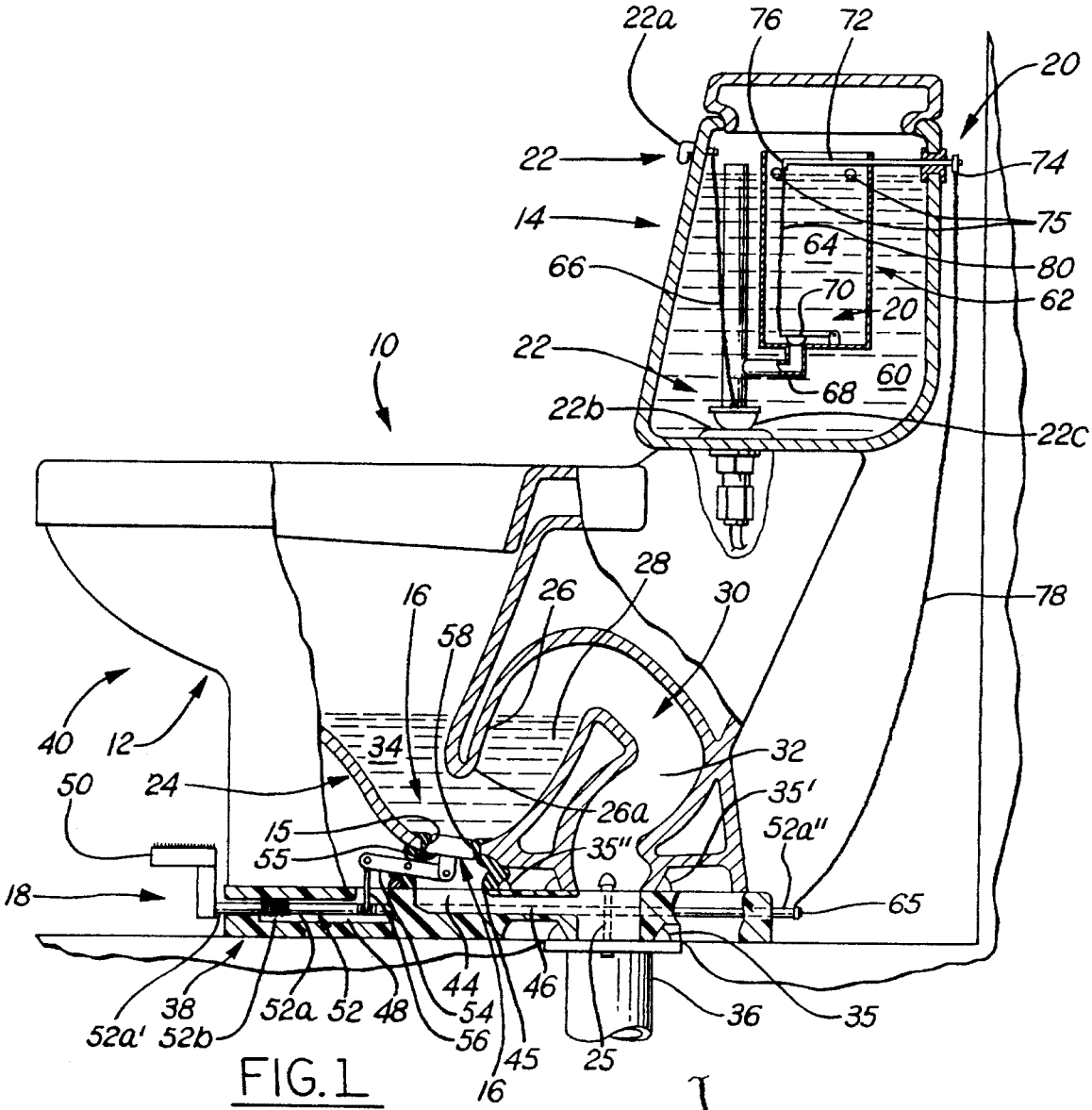
FIG. 1 is a partly sectional side view of a two flush modality toilet according to the present invention, showing a mechanically actuated form thereof.

Referring now to FIG. 1, a two flush modality toilet 10 according to the present invention is depicted. The two flush modality toilet 10 includes a bowl 12, a tank 14, a bowl valve 16 composed of a bowl valve stopper 55 and a bowl valve seat 58 therefor, a bowl valve control 18, and an auxiliary flush control 20 at the tank. The tank 14 is connected with an external source of pressurized potable water via a supply pipe P in a conventional manner well known in the art. The structure and function for providing actuation of the conventional flush modality is determined conventionally by operation of a conventional flush control 22 including: a conventional flush lever 22*a*, a conventional flush feed 22*b* for supplying flush water from the tank to the bowl, a conventional float stopper 22*c* for selectively sealing the conventional flush feed, and a conventional tank water height sensing water inflow valve 23 which is connected to the supply pipe P for refilling the tank with flush water. Preferably, the conventional tank water height sensing water inflow valve is of the kind without a ball-float and rod-arm, as these components could make the tank interior too crowded to allow for the auxiliary flush control, as for example the FLUIDMASTER (a registered trademark) Model 400A fill valve manufactured by Fluidmaster, Inc. of Anaheim, Calif. 92803.

The bowl 12 includes a trap 24 defined by a depending projection 26, an upleg portion 28 of the bowl outlet 30, and a downleg portion 32 of the bowl outlet. The upleg and downleg portions 28, 32 are of a generally inverted U-shape, wherein the upleg portion defines in part the bottom portion of the bowl 12. The height of the upleg portion 28 is higher than the location of the terminous 26*a* of the depending projection 26. Accordingly, when water 34 fills the trap 24 at the bottom portion of the bowl 12 to a height approximated by the height of the upleg portion 28, the water immerses the terminous 26*a* of the depending projection 26, thereby sealing-off the bowl from the drain 36. The trap 24 has a lowest point whereat the bowl valve 16 is located; accordingly, when the bowl valve is opened all the liquid in the trap will drain therethrough.

In operation, when a user has completed using the two flush modality toilet 10 the user selects the flush modality. If solid (and/or liquid) waste is present in the bowl 12, the user selects the conventional flush modality by pressing the conventional flush lever 22*a*. If only liquid waste is present in the bowl 12, the user may select (as an alternative to selecting the conventional flush modality) a urinal flush modality by actuating the bowl valve 16 to thereby drain the liquid waste from the bowl and actuating the auxiliary flush control 20 to thereby restore the water at the trap 24 of the bowl 12.

The structure and function for carrying out the two flush modality toilet 10 will be detailed hereinbelow with reference being additionally directed to FIGS. 2 through 6.

Figure 2:
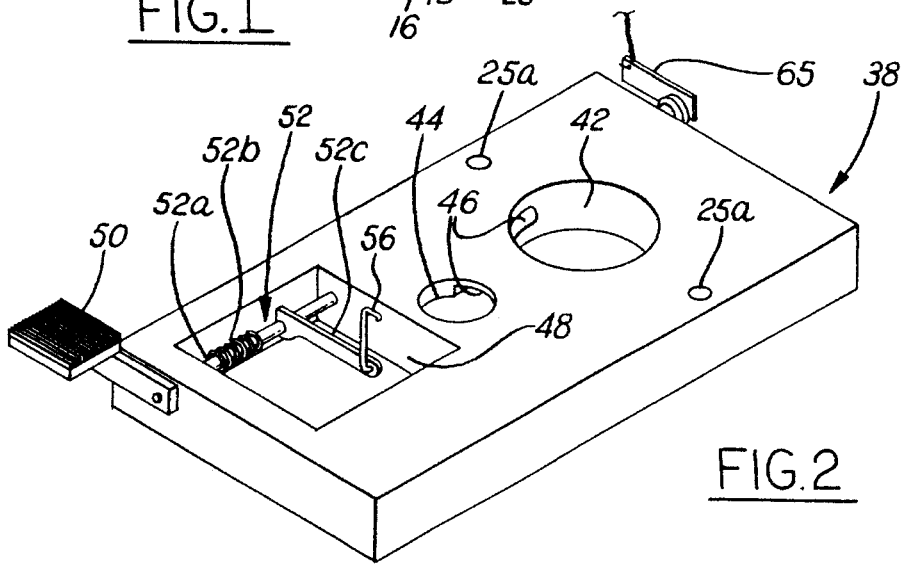
FIG. 2 is a perspective view of a base for the two flush modality toilet of FIG. 1.

A base 38 is provided, preferably constructed of plastic, which forms a platform upon which the toilet proper 40 is situated. As shown in FIG. 2, and as can be appreciated by comparative reference to FIG. 1, the base 38 is provided with a drain hole 42, a drain cavity 44 connected with the drain hole 42 via a passageway 46, and a recess 48. (There is no communication between the recess and the drain cavity.) The drain hole 42 is aligned with the downleg portion 32 of the bowl outlet 30 and is in sealing relation thereto via a wax seal 35'. The drain cavity 44 is aligned with a bowl valve throat 45 (which carries the aforementioned bowl valve seat 58) via a wax seal 35". Consequently, when the conventional flush modality is selected, flushing discharge from the bowl 12 exits the bowl outlet 30, goes into the drain hole 42 and into the drain 36. Consequently further, when the urinal flush modality is selected, the liquid in the trap 24 drains out the bowl valve 16, goes through the the bowl valve throat 45, enters into the drain cavity 44, passes through the passageway 46, enters into the drain hole 42, and then enters into the drain 36.

The bowl valve throat 45 is preferably constructed of a stiff elastomeric material, and the bowl valve seat 58 is either integrally formed with the bowl valve throat, or is separately sealingly engaged with respect thereto. The bowl is provided with an aperture 15 at the lowest point of the trap 24, whereat the bowl valve throat is sealingly engaged, such as by a press fit therebetween which may be further sealed by a sealant therebetween. In this regard, the bowl valve stopper 55 is composed of any suitable material which will seal it with the bowl valve seat 58.

The base 38 is mounted to the bottom of the toilet proper 40 by any suitable methodology, such as by the toilet mounting bolts 25, wherein holes 25*a* are provided therefor in the base. The base 38 is sealed with respect to the drain 36 via a wax seal 35.

The bowl valve control 18 is composed of a foot pedal 50, a linkage 52, and an actuation lever 54 which is pivotally connected with the bowl valve stopper 55. The linkage 52 includes a linkage rod 52*a*, a biasing spring 52*b*, and a linkage arm 52*c* connected with the linkage rod. The linkage 52 is generally situated within the recess 48, wherein the linkage rod 52*a* is pivotally mounted thereto, and wherein a first portion 52*a*' exits the base 38 and connects with the foot pedal 50. A link 56 connects the linkage 52 at the linkage arm 52*c* to the actuation lever 54. The actuation lever 54 is pivotally connected with the bowl valve throat 45 and is generally in sealing relation therewith. The biasing spring 52*b* biases the linkage rod 52*a* so that the bowl valve stopper 55 is in sealing engagement with the bowl valve seat 58, wherein the bowl valve 16 is in the closed state.

Figure 5:
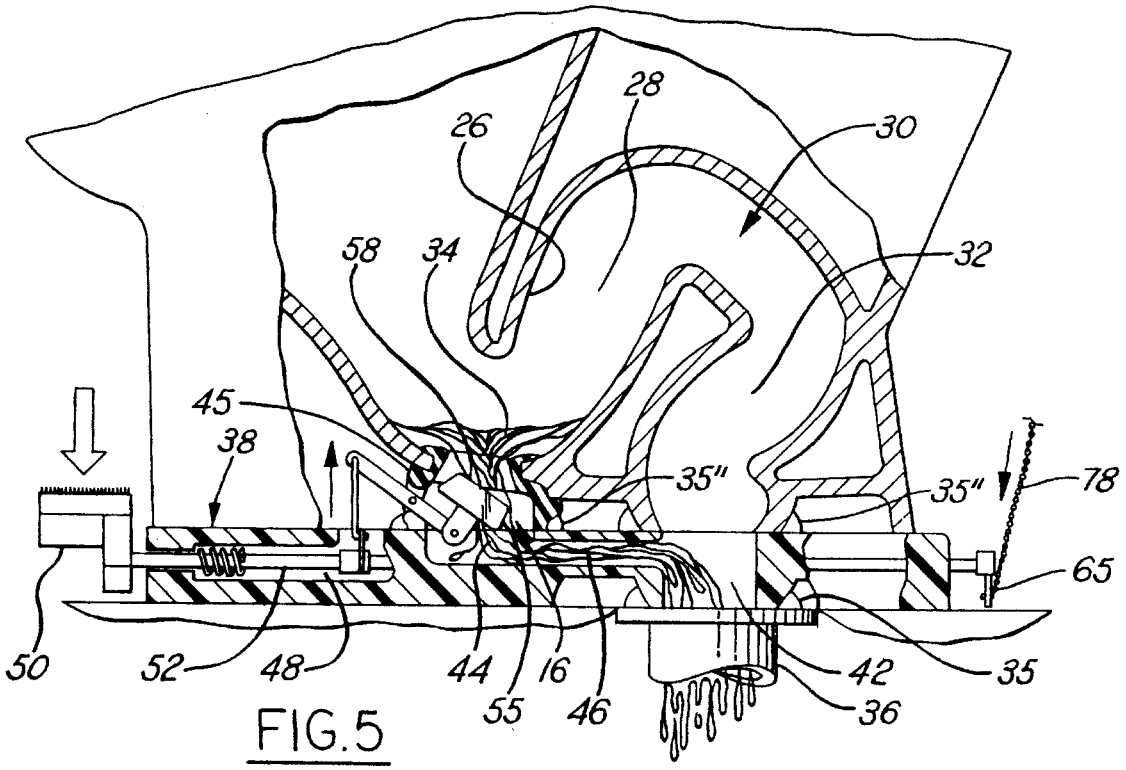
FIG. 5 is a partly sectional detail view of the bowl and base of the two flush modality toilet of FIG. 1, shown with the flush valve in an open state.

In operation, as shown in FIGS. 4 and 5, when the foot pedal 50 is depressed to a down position against biasing of the biasing spring 52*b*, the actuation lever 54 pivots and pulls the bowl valve stopper 55 of the bowl valve 16 downwardly away from the bowl valve seat 58, wherein the bowl valve is in the open state. Now, whatever liquid is in the bowl will drain in accordance with the above recounted urinal flush modality through the bowl valve throat and, as recounted, into the drain 36. Upon release of the foot pedal 50, the biasing of the biasing spring 52*b* will cause the foot pedal to rise to an up position and the bowl stopper 55 of the bowl valve 16 to reseat in sealing relation with respect to the bowl valve seat 58, wherein the bowl valve is returned to the closed state.

In order that the proper amount of flush water is introduced into the bowl 12 depending upon the selected flush modality, the tank 14 is equipped with two flush controls: a conventional flush control 22 and an auxiliary flush control 20.

When the conventional flush modality is selected, the conventional flush lever 22*a* is turned, separating the float stopper 22*c* from the conventional flush feed 22*b* in a conventional manner, wherein new water will enter into the tank from the external water line via the conventional tank water height sensing water inflow valve. Flush water 60 from the tank 14 will enter into the bowl 12 conventionally and exit the bowl outlet 30 as described hereinabove. After the flush water 60 is exhausted, the conventional float stopper 22*c* sealingly seats on the conventional flush feed 22*b*, and the conventional tank water height sensing water inflow valve within the tank will turn off the incoming water when the tank water reaches its predetermined height.

When the urinal flush modality is selected, it is desired to only supply enough water to the bowl 12 to refill the trap 24; about one gallon is sufficient for this purpose. In order that not all the tank water is flushed into the bowl 12 when the foot pedal 50 is depressed, an auxiliary tank 62 is provided within the tank 14, wherein the auxiliary tank holds auxiliary flush water 64 having a volume only enough to fill the trap 24, again, more-or-less about a gallon of water.

The linkage rod 52*a* includes a second portion 52*a*" which exits the base 38 and connects with a primary arm 65. The auxiliary tank 62 is connected at its bottom to a conventional overflow tube 66 which is conventionally connected with the bowl and which has been modified to receive an elbow 68 from the auxiliary tank. The bottom of the auxiliary tank 62 includes an auxiliary float stopper 70 seated with respect to the elbow 68 at a seat 68*a* formed therein in a manner similar with respect to the conventional float stopper 22*c* and the conventional flush feed 22*b*. A control rod 72 is pivotally mounted to the auxiliary tank 62 and exits the tank 14 at its rear through a gasketed hole in the tank situated higher than the fill height of the flush water 60. A secondary arm 74 is connected with the control rod external to the tank 14. A tertiary arm 76 is mounted to the control rod 72 internal to the auxiliary tank 62. A first flexible linkage 78, preferably a fine link chain, connects together the primary and secondary arms 65, 74. A second flexible linkage 80, also preferably a fine link chain, connects together the tertiary arm 76 and the auxiliary float stopper 70.

Figure 6:
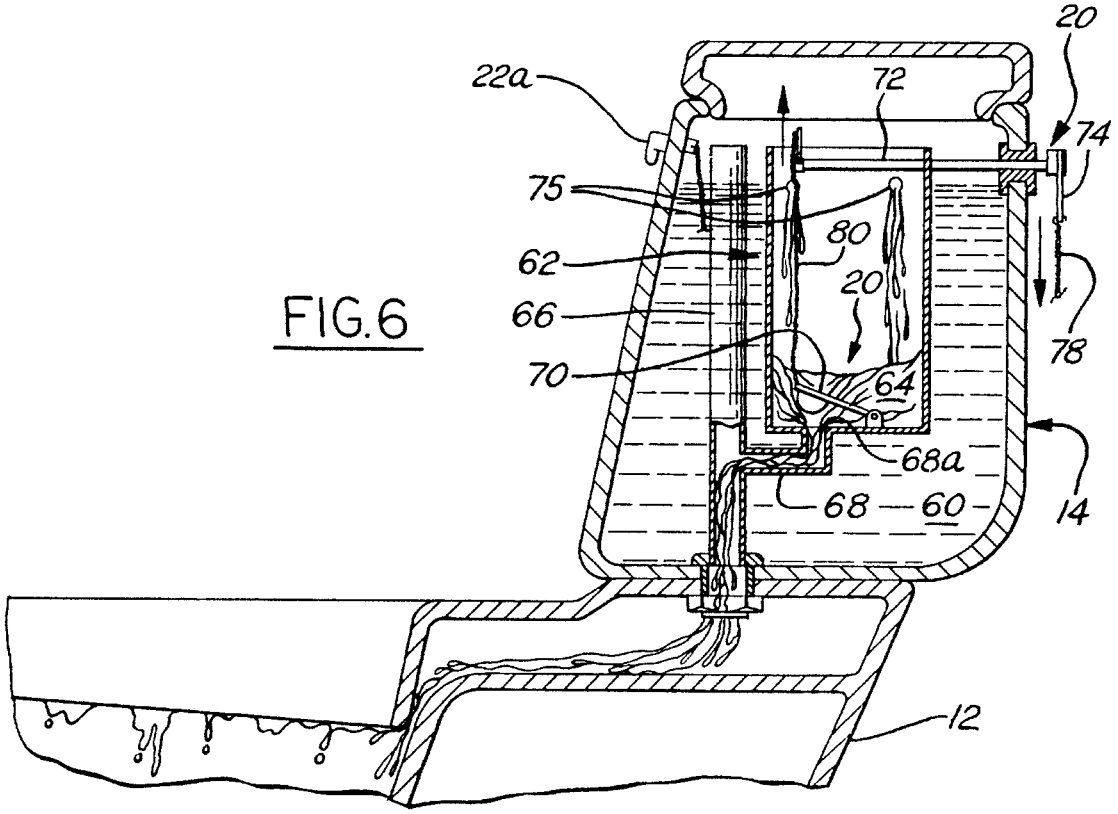
FIG. 6 is a partly sectional side view of the tank of the two flush modality toilet of FIG. 1, shown delivering auxiliary flush water to the bowl.

In operation, as shown in FIGS. 1, 3 and 6, when the foot pedal 50 is depressed, the primary arm 65 rotates, causing the secondary arm 74 to rotate, the tertiary arm 76 to rotate and the auxiliary float stopper 70 to separate from its seat 68*a*, whereupon the auxiliary flush water 64 in the auxiliary tank 62 passes through the elbow 68, into the overflow tube 66 and thereupon into the bowl 12, thereby replenishing the trap 24 with water. Entry holes 75 in the auxiliary tank 62, preferably located just at or just below the fill height of the tank flush water 60, allow tank flush water 60 to enter into the auxiliary tank relatively slowly as compared to the rate at which the auxiliary tank flush water 64 exits at the elbow 68, so that basically only the volume of water in the auxiliary tank (and what little also enters through the entry holes 75 during auxiliary flush water exiting) exits to fill the trap 24. New water will enter into the tank 14 and into the auxiliary tank 62 via the conventional tank water height sensing water inflow valve of the tank 14 until the preset fill height of flush water 60 in the tank is reached, whereupon both the tank and the auxiliary tank will be refilled with flush water, respectively.

It will be noted that the original trap water 34 will very quickly drain at the bowl valve 16 as soon as it is opened, so that by the time the auxiliary tank water 64 enters into the bowl 12, the bowl valve stopper 55 has been, or momentarily will be, sealingly reseated against the bowl valve seat 58. Accordingly, only a short depress time is needed with respect to the foot pedal 50 to effect an auxiliary flush cycle.

The remaining Figures show variations of the two flush modality toilet according to the present invention, wherein like numerals identify like functioning components to those described herein above.

Figure 7B:
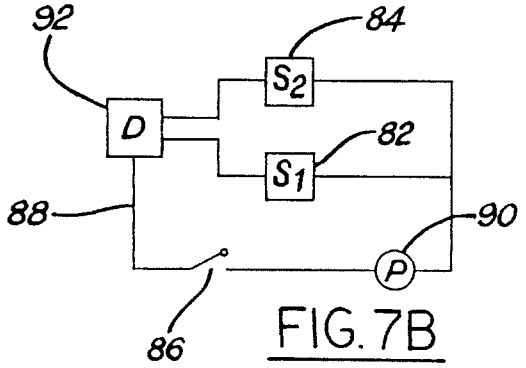
FIG. 7B is an exemplary circuit schematic for carrying out the electrical function of the two flush modality toilet of FIG. 7A.
Figure 7A:
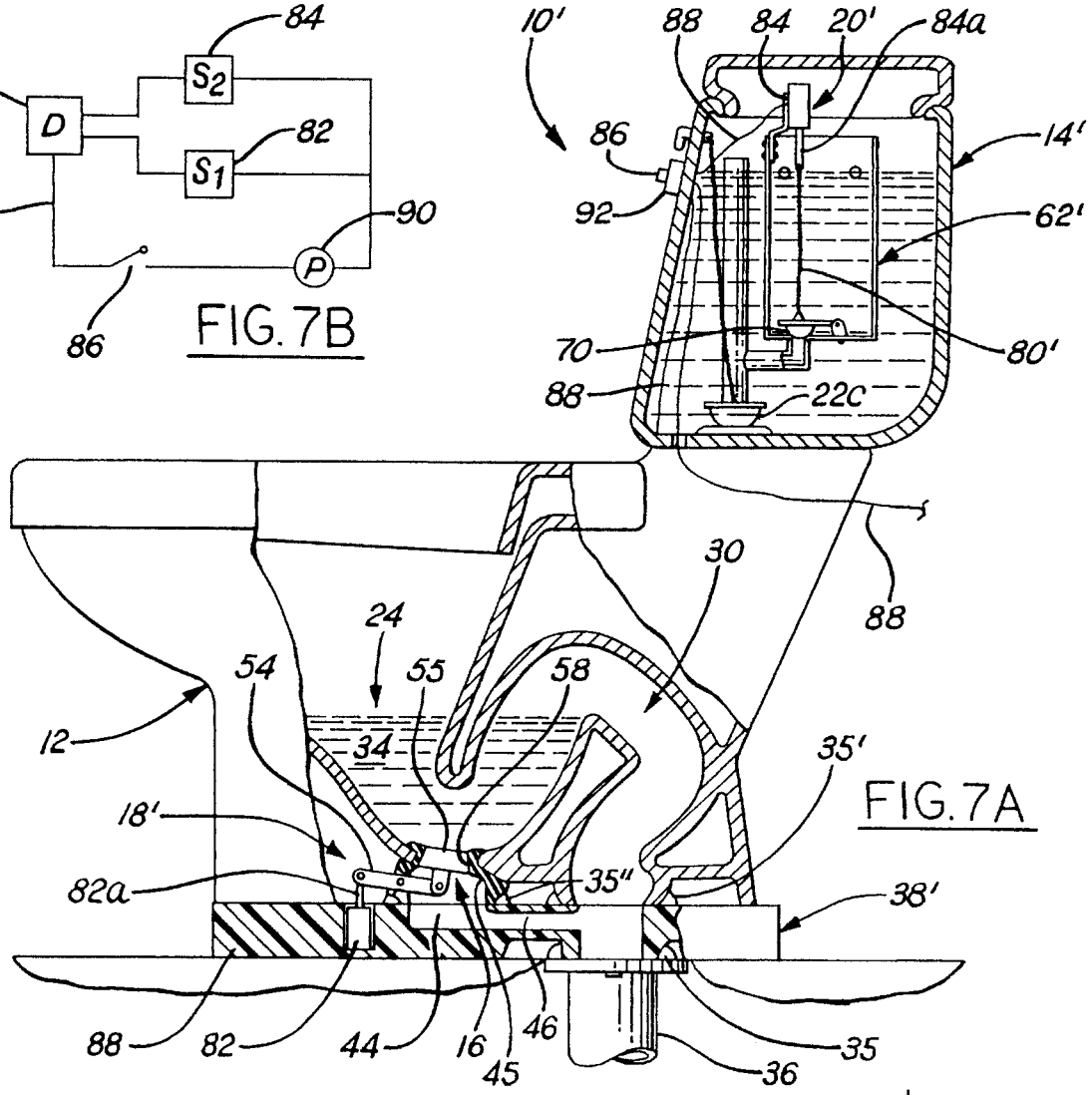
FIG. 7A is a partly sectional side view of a two flush modality toilet according to the present invention, showing an electrically actuated form thereof.

FIG. 7A depicts a two flush modality toilet 10' wherein the urinal flush modality is electrically controlled, and wherein FIG. 7B depicts an exemplary electrical schematic therefor.

The bowl valve control 18' is composed of a first solenoid 82 connected with the base 38' and an actuator 82*a* that is pivotally connected to the actuation lever 54 to thereby selectively control the open and closed states of the bowl valve 16. The auxiliary flush control 20' is composed of a second solenoid 84 connected with the auxiliary tank 62' and an actuator 84*a* connected with the second flexible linkage 80' to thereby control operation of the auxiliary float stopper 70. A momentary push button switch 86 is mounted to the tank 14'. Wires 88 electrically connect the first and second solenoids 82, 84 to a source of low voltage electrical power 90, such as supplied by a transformer connected to a utility electrical supply having ground fault circuit protection. A delay control 92 controls the duration during which the first solenoid 82 actuates, during which time the trap water 34 drains out the bowl valve 16; thereafter, the delay control actuates the second solenoid 84 for a preset time, during which the auxiliary tank flush water 64 drains into the trap 24.

Figure 8:
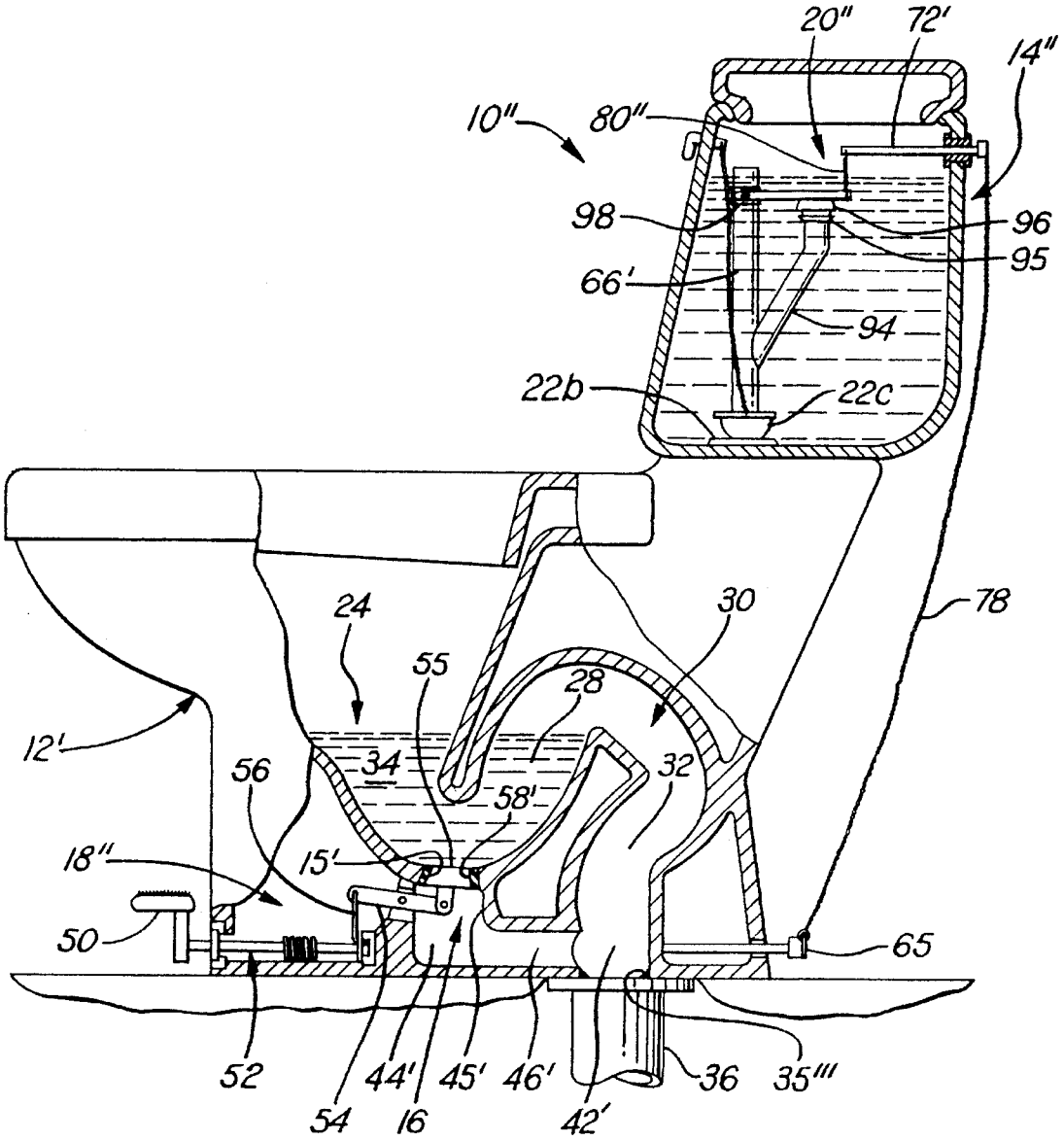
FIG. 8 is a partly sectional side view of a two flush modality toilet according to the present invention, showing a mechanically actuated form thereof absent a separate base, and depicting an alternative auxiliary flush control.
Figure 9:
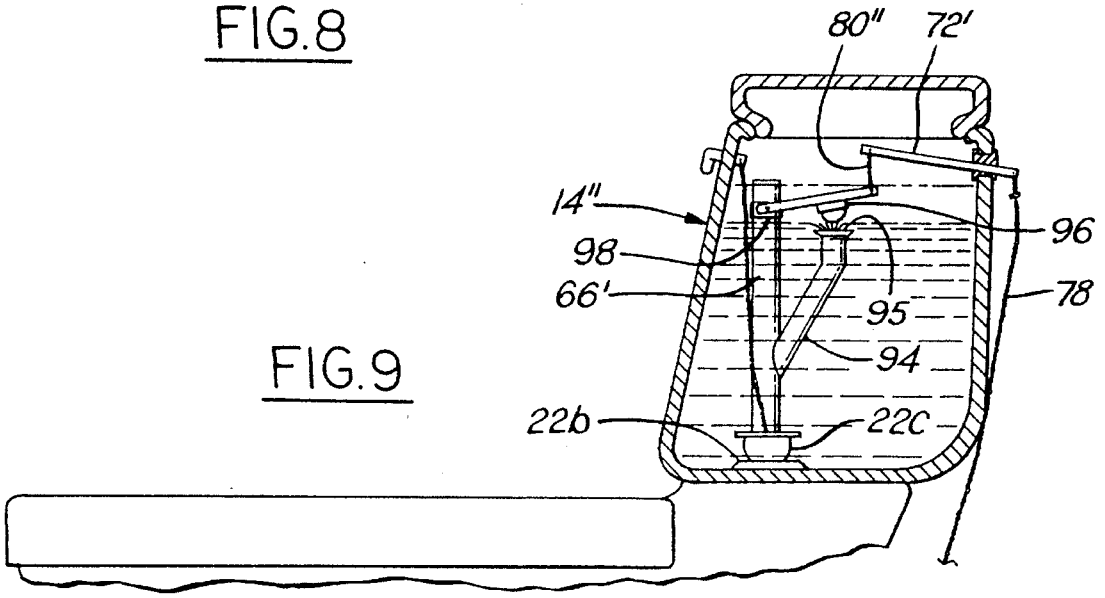
FIG. 9 is a partly sectional side view of a tank of the two flush modality toilet of FIG. 8, showing the auxiliary flush control thereof in operation providing auxiliary flush water to the bowl.

FIGS. 8 and 9 depict a two flush modality toilet 10" having an alternative tank structure for effecting the requisite limited amount of auxiliary flush water for the urinal flush modality. This structure may be used with either a manual or electrical urinal flush modality.

Rather than incorporate an auxiliary tank as recounted hereinabove, the tank flush water is, itself, used, but only to a limited depth. To accomplish this, the auxiliary flush control 20" has an overflow tube 66' is modified to accept connection with an auxiliary flush tube 94. The auxiliary flush tube 94 connects to the overflow tube 66' somewhat near the bottom of the tank 14" and emanates therefrom at an acute angle, then bends into a vertical orientation that is parallel with the overflow tube 66'. The end of the auxiliary flush tube 94 is provided with a stopper seat 95 for an auxiliary float stopper 96 to seal against. The auxiliary float stopper 96 is pivotally connected to the overflow tube 66' via a studded ring 98 mounted thereupon. The auxiliary float stopper 96 is connected with a second flexible linkage 80" which is in turn connected to a control rod 72'. As shown in FIG. 9, the height of the stopper seat 95 is located a predetermined distance beneath the preset fill height of the flush water in the tank 14" so that substantially the amount of water needed to fill the trap 24 is above the stopper seat 95 and exits the tank (inclusive of whatever new water enters into the tank via the conventional tank water height sensing water inflow valve during exiting of water through the auxiliary flush tube), more-or-less about one gallon of water. An example of a known product that could be used as an auxiliary float stopper (perhaps with some mortification) is a Touch Flush Assembly, product no. 628P of Lavelle Industries, Inc. of Burlington, Wis. 53105.

In operation, upon the auxiliary float stopper 96 being raised by pulling of the second flexible linkage 80", new water will enter into the tank 14" via the conventional tank water height sensing water inflow valve until the preset height of flush water in the tank is reached, whereupon the tank will be refilled.

It will be noted that the bowl valve control 18" depicted in FIG. 8 does not show a separate base 38, but rather incorporates a base-like structure directly into the bowl 12' of the toilet itself, inclusive of a bowl valve throat 45', a bowl valve seat 58', drain hole 42', drain cavity 44' and a passageway 46'. In this regard, the bowl valve seat 58' is an elastomeric material that has been sealably connected with the bowl 12' at an aperture 15' formed at the lowest point thereof. A separate base is preferred to effect retrofitting of existing toilets (see below), but is not required for the production of toilets incorporating a two flush modality, wherein the base is desirably formed into the toilet itself. A wax seal 35"' seals the bowl outlet 30 with respect to the drain 36.

Figure 10A:
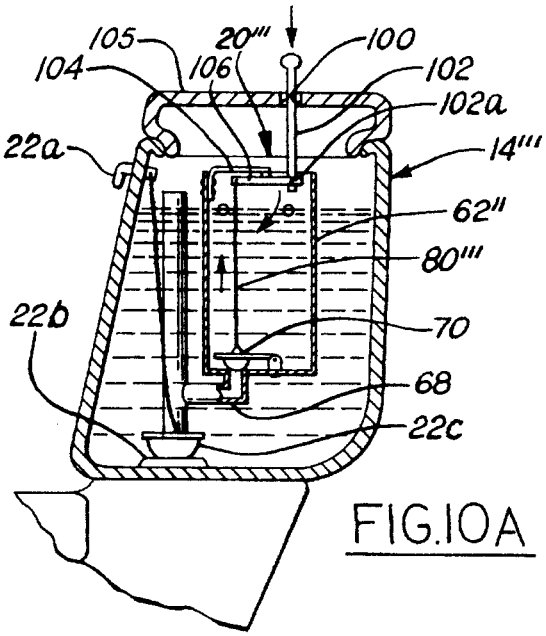
FIG. 10A is a partly sectional side view of the tank of a two flush modality toilet according to the present invention, showing one form of a separately operable tank mounted auxiliary flush control.
Figure 10B:
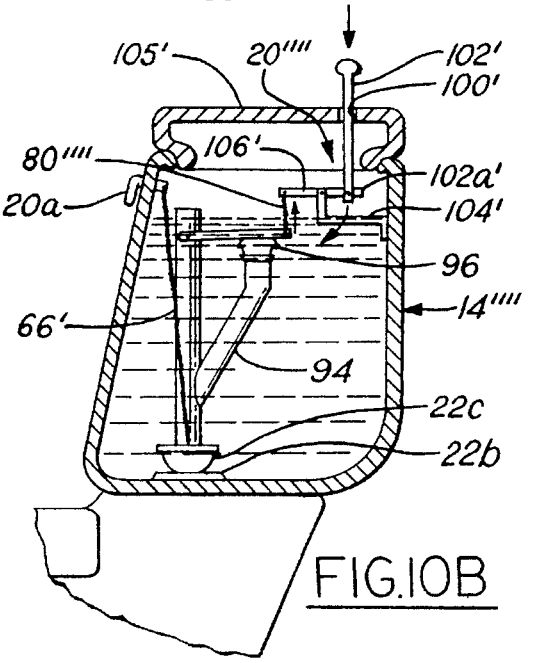
FIG. 10B is a partly sectional side view of the tank of a two flush modality toilet according to the present invention, showing another form of a separately operable tank mounted auxiliary flush control.

FIGS. 10A and 10B depict a two flush modality toilet according to the present invention wherein the auxiliary flush control is operated independent from the foot pedal 50. The structure depicted in FIG. 10A is associated with the structure previously discussed relative to FIGS. 1 through 6, whereas the structure depicted in FIG. 10B is associated with the structure previously discussed with respect to FIGS. 8 and 9. It is to be understood that in manual operation, the user would first depress the foot pedal 50 to cause the bowl valve 16 to be in an open state whereby the liquid in the trap 24 drains out the bowl valve, and then would release the foot pedal to restore the bowl valve to the closed state whereby sealing of the bowl valve stopper to the bowl valve seat is effected (for electrical operation, a solenoid would effect the aforesaid movements), and then effect auxiliary flushing via movement of a push rod mounted to the tank, as described hereinbelow.

As shown in FIG. 10A, the auxiliary flush control 20"' has an auxiliary tank 62", wherein the top 105 of the tank 14"' has a hole 100 through which a push rod 102 is slidable. A lever 106 is pivotally connected with a bracket 104 that is attached to the auxiliary tank 62". The distal end 102*a* of the push rod 102 pivotally connects with one end of the lever 106 and an appropriate length flexible member 80"' connects with the other end of the lever 106. The flexible member 80"', in turn, connects with the auxiliary float stopper 70. A downward movement of the push rod results in an upward movement of the auxiliary float stopper, whereupon auxiliary flush water enters the bowl in the manner discussed hereinabove.

As shown in FIG. 10B, the auxiliary flush control 20"" has an auxiliary flush tube 94 and, as in FIG. 10A, the top 105' of the tank 14"" has a hole 100' and a push rod 102' that is slidable with respect thereto. A lever 106' is pivotally connected with a bracket 104' that is attached to the tank 14"". The distal end 102*a*' of the push rod 102' pivotally connects with one end of the lever 106' and an appropriate length flexible member 80"" connects with the other end of the lever 106'. The flexible member 80"", in turn, connects with the auxiliary float stopper 96. A downward movement of the push rod results in an upward movement of the auxiliary float stopper, whereupon auxiliary flush water enters the bowl in the manner discussed hereinabove.

It will be appreciated that a conventional toilet can be retrofitted to function with a two flush modality, wherein a bowl valve 16 is provided in the bowl by drilling thereinto an aperture 15 at the low point of the trap and providing a form fitting elastomeric bowl valve throat 45 with bowl valve seat 58, providing a bowl valve control 18, fitting a base 38 to the bottom of the toilet, and providing an auxiliary flush control 20. For example, the two flush modality toilet shown in FIG. 1 may be considered a depiction of such a retrofitted toilet.

To those skilled in the art to which this invention appertains, the above described preferred embodiment may be subject to change or modification. For example, either or both of the bowl valve seat and the bowl valve stopper may be composed of an elastomeric material or either may be selectively composed of another mutually sealing material or materials. Such change or modification can be carried out without departing from the scope of the invention, which is intended to be limited only by the scope of the appended claims.

What is claimed is:

1. A toilet having two flush modalities, the toilet being structured for connecting to a drain and to a source of pressurized water, the toilet comprising:

a tank having an overflow tube;

tank fill means connected with said tank for filling said tank with a preselected amount of water derived from a source of pressurized water;

a bowl connected with said tank, said bowl having a trap formed therein for holding liquid, said trap having a lowest point, said bowl having a bowl outlet connected with said trap, wherein the overflow tube is connected with said bowl;

conventional flush modality means connected with said tank for selectively delivering a first predetermined amount of water from said tank into said bowl to thereby both flush said bowl through said bowl outlet and refill said trap with water; and urinal flush modality means comprising:

bowl valve means connected with said trap at said lowest point thereof for retaining liquid in said trap when in a closed state and for draining therethrough liquid in said trap into the drain when in an open state;

bowl valve control means for selecting said open and closed states of said bowl valve means;

drain connection means for connecting said bowl outlet and said bowl valve means to a drain so that water therefrom enters the drain; and auxiliary flush control means for selectively delivering a second predetermined amount of water to said bowl, wherein said second predetermined amount of water is substantially just sufficient to thereby refill said trap with water after substantially all liquid in said bowl has been drained by said bowl valve means when said bowl valve means is in said closed state;

wherein said tank and said tank fill means collectively provide a source of said first predetermined amount of water.

2. The two flush modality toilet of claim 1, wherein said bowl valve means and said bowl valve control means comprise:

a bowl valve located at said low point of said trap, said bowl valve comprising:

said bowl having an aperture at said low point thereof;

a bowl valve seat located substantially at said aperture and sealed with respect to said bowl;

a bowl valve stopper structured to sealingly engage said bowl valve seat; and means for selectively moving said bowl valve stopper into and out of sealing engagement with said bowl valve seat, wherein said bowl valve is in said closed state when said bowl valve stopper is sealingly engaged with respect to said bowl valve seat, and said bowl valve is in said open state when said bowl valve stopper is separated from said bowl valve seat.

3. The two flush modality toilet of claim 2, wherein said means for selectively moving said bowl valve stopper comprises:

a foot pedal movable with respect to said bowl from an up position to a down position;

linkage means for translating movement of said foot pedal into movement of said bowl valve stopper, wherein said bowl valve stopper is in sealing engagement with said bowl valve seat when said foot pedal is in said up position and said bowl valve stopper is separated from said bowl valve seat when said foot pedal in in said down position; and biasing means connected with said linkage means for biasing said bowl valve stopper into sealing engagement with said bowl valve seat and for biasing said foot pedal into said up position.

4. The two flush modality flush toilet of claim 3, wherein said auxiliary flush control means comprises:

an auxiliary tank situated within said tank for holding substantially said second predetermined amount of water;

tube means for connecting said auxiliary tank to the overflow tube, said tube means having an open end in said auxiliary tank;

control means for selectively regulating water flow through said tube means from said auxiliary tank to the overflow tube; and refill means for refilling said auxiliary tank with water from said tank fill means.

5. The two flush modality toilet of claim 4, wherein said foot pedal is connected with said control means, wherein when said foot pedal is moved to said down position, water in said auxiliary tank enters into the overflow tube.

6. The two flush modality toilet of claim 5, where said control means comprises:

auxiliary float stopper means for selectively sealing said open end of said tube means; and auxiliary float stopper control means for selectively releasing said auxiliary float stopper means from sealing engagement with said open end to thereby cause water in said auxiliary tank to enter into the overflow tube.

7. The two flush modality toilet of claim 6, wherein said auxiliary float stopper control means comprises:

a push rod slidably mounted with respect to said tank; and means for connecting said float stopper means to said push rod, wherein sliding movement of said push rod relative to said tank controls sealing engagement of said float stopper means with respect to said open end.

8. The two flush modality toilet of claim 3, wherein said auxiliary flush control means comprises:

an auxiliary flush tube connected with the overflow tube, wherein said auxiliary flush tube has an open end located at a predetermined location in said tank wherein an amount of water above said open end which is determined by said tank fill means substantially is said second predetermined amount of water;

auxiliary float stopper means for selectively sealing said open end of said auxiliary flush tube; and auxiliary float stopper control means for selectively releasing said auxiliary float stopper means from sealing engagement with said open end to thereby cause water in said tank to enter into the overflow tube.

9. The two flush modality toilet of claim 8, wherein said foot pedal is connected with said auxiliary float stopper control means, wherein when said foot pedal is moved to said down position, water in said tank enters into the overflow tube.

10. The two flush modality toilet of claim 8, wherein said auxiliary float stopper control means comprises:

a push rod slidably mounted with respect to said tank; and means for connecting said auxiliary float stopper means to said push rod, wherein sliding movement of said push rod relative to said tank controls sealing engagement of said auxiliary float stopper means with respect to said open end.

11. The two flush modality toilet of claim 2, wherein said means for selectively moving said bowl valve stopper and said auxiliary flush control means comprise:

first solenoid means for moving said bowl valve stopper;

water flow control means for directing said second predetermined amount of water from said tank into the overflow tube;

second solenoid means for selectively actuating said water flow control means; and low voltage electrical circuit means for selectively actuating said first and second solenoids.

12. The two flush modality flush toilet of claim 11, wherein said water flow control means comprises:

an auxiliary tank situated within said tank for holding substantially said second predetermined amount of water;

tube means for connecting said auxiliary tank to the overflow tube, said tube means having an open end in said auxiliary tank;

auxiliary float stopper means for selectively sealing said open end of said tube means;

connection means for connecting said auxiliary float stopper means to said second solenoid means for selectively releasing said auxiliary float stopper means from sealing engagement with said open end to thereby cause water in said auxiliary tank to enter into the overflow tube; and refill means for refilling said auxiliary tank with water from said tank fill means.

13. The two flush modality toilet of claim 11, wherein said water flow control means comprises:

an auxiliary flush tube connected with the overflow tube, wherein said auxiliary flush tube has an open end located at a predetermined location in said tank wherein an amount of water above said open end which is determined by said tank fill means substantially is said second predetermined amount of water;

auxiliary float stopper means for selectively sealing said open end of said auxiliary flush tube; and connection means for connecting said auxiliary float stopper to said second solenoid means for selectively releasing said auxiliary float stopper means from sealing engagement with said open end to thereby cause water in said tank to enter into the overflow tube.

14. The two flush modality toilet of claim 2, wherein said drain connection means comprises:

a base adjacent said bowl, said base having a drain hole, drain cavity, and a passageway connecting said drain cavity with said drain hole;

means for connecting and sealing said bowl outlet with respect to said drain hole;

means for connecting and sealing said drain hole with respect to the drain; and means for connecting and sealing said drain cavity with respect to said said bowl valve seat.

* * * * *